US010514165B2

(12) United States Patent
Karkow et al.

(10) Patent No.: US 10,514,165 B2
(45) Date of Patent: Dec. 24, 2019

(54) PERFORATED FLAME HOLDER AND SYSTEM INCLUDING PROTECTION FROM ABRASIVE OR CORROSIVE FUEL

(71) Applicant: CLEARSIGN COMBUSTION CORPORATION, Seattle, WA (US)

(72) Inventors: Douglas W. Karkow, Mount Vernon, IA (US); Joseph Colannino, Oceanside, CA (US); James K. Dansie, Seattle, WA (US); Jesse Dumas, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 197 days.

(21) Appl. No.: 15/637,820

(22) Filed: Jun. 29, 2017

(65) Prior Publication Data

US 2018/0031229 A1 Feb. 1, 2018

Related U.S. Application Data

(60) Provisional application No. 62/368,439, filed on Jul. 29, 2016.

(51) Int. Cl.
*F23D 1/00* (2006.01)
*F23C 99/00* (2006.01)

(52) U.S. Cl.
CPC ..... *F23D 1/00* (2013.01); *F23C 99/001* (2013.01); *F23D 2201/30* (2013.01)

(58) Field of Classification Search
CPC ..... F23C 99/001; F23C 2201/00; F23C 2900/00; F23C 6/042; F23C 9/06; F23G 7/10; F23D 14/26; F23D 14/14; F23D 11/446; F23D 11/02; F23D 11/383; F23D 11/406; F23D 11/38; F23D 14/24; F23D 14/84; F23D 14/145; F23D 2203/1023; F23D 2203/104; F23D 2207/00; F23D 2203/105; F23D 2203/102; F23D 1/00; F23D 14/70; F23D 14/74; F23D 14/02;
(Continued)

(56) References Cited

U.S. PATENT DOCUMENTS 2,095,065 A 10/1937 Hays
2,942,420 A 6/1960 Clark
(Continued)

FOREIGN PATENT DOCUMENTS

CN 101046304 10/2007
CN 101294714 10/2008
(Continued)

OTHER PUBLICATIONS

International Search Report and Written Opinion dated May 29, 2015 for PCT International Application No. PCT/US2015/016200, filed Feb. 17, 2015, 34 pages.
(Continued)

*Primary Examiner* — Alfred Basichas
(74) *Attorney, Agent, or Firm* — Christopher A. Wiklof; Nicholas S. Bromer; Launchpad IP, Inc.

(57) ABSTRACT

A burner system that employs a perforated flame holder and is configured to combust a powdered solid fuel includes a structure configured to protect the perforated flame holder from erosion caused by particles of the solid fuel.

33 Claims, 11 Drawing Sheets

(58) Field of Classification Search
CPC ..... F23D 11/42; F23D 11/448; F23L 7/007; F23N 1/002; F23N 5/265; F23N 2021/00; F23N 2027/22; F23N 2900/00; F23N 1/00; F23N 1/02; F23N 5/00; F27D 11/06; Y02T 50/677
See application file for complete search history.

(56) References Cited

U.S. PATENT DOCUMENTS

| | | | |
|---|---|---|---|
| 3,306,338 | A | 2/1967 | Wright et al. |
| 3,324,924 | A | 6/1967 | Hailstone et al. |
| 4,021,188 | A | 5/1977 | Yamagishi et al. |
| 4,111,636 | A | 9/1978 | Goldberg |
| 4,408,461 | A | 10/1983 | Bruhwiler et al. |
| 4,483,673 | A | 11/1984 | Murai et al. |
| 4,643,667 | A | 2/1987 | Fleming |
| 4,673,349 | A | 6/1987 | Abe et al. |
| 4,752,213 | A | 6/1988 | Grochowski et al. |
| 5,326,257 | A | 7/1994 | Taylor et al. |
| 5,375,999 | A | 12/1994 | Aizawa et al. |
| 5,409,375 | A | 4/1995 | Butcher |
| 5,441,402 | A | 8/1995 | Reuther et al. |
| 5,522,723 | A | 6/1996 | Durst et al. |
| 5,641,282 | A | 6/1997 | Lee et al. |
| 5,784,889 | A | 7/1998 | Joos et al. |
| 5,890,886 | A | 4/1999 | Doker et al. |
| 5,993,192 | A | 11/1999 | Schmidt et al. |
| 6,997,701 | B2 | 2/2006 | Volkert et al. |
| 8,851,882 | B2 | 10/2014 | Hartwick et al. |
| 8,881,535 | B2 | 11/2014 | Hartwick et al. |
| 8,911,699 | B2 | 12/2014 | Colannino et al. |
| 9,151,549 | B2 | 10/2015 | Goodson et al. |
| 9,209,654 | B2 | 12/2015 | Colannino et al. |
| 9,243,800 | B2 | 1/2016 | Goodson et al. |
| 9,267,680 | B2 | 2/2016 | Goodson et al. |
| 9,284,886 | B2 | 3/2016 | Breidenthal et al. |
| 9,289,780 | B2 | 3/2016 | Goodson |
| 9,310,077 | B2 | 4/2016 | Breidenthal et al. |
| 9,366,427 | B2 | 6/2016 | Sonnichsen et al. |
| 9,371,994 | B2 | 6/2016 | Goodson et al. |
| 9,377,188 | B2 | 6/2016 | Ruiz et al. |
| 9,377,189 | B2 | 6/2016 | Ruiz et al. |
| 9,377,190 | B2 | 6/2016 | Karkow et al. |
| 9,377,195 | B2 | 6/2016 | Goodson et al. |
| 9,388,981 | B2 | 7/2016 | Karkow et al. |
| 9,441,834 | B2 | 9/2016 | Colannino et al. |
| 9,447,965 | B2 | 9/2016 | Karkow et al. |
| 9,453,640 | B2 | 9/2016 | Krichtafovitch et al. |
| 9,469,819 | B2 | 10/2016 | Wiklof |
| 9,494,317 | B2 | 11/2016 | Krichtafovitch et al. |
| 9,496,688 | B2 | 11/2016 | Krichtafovitch et al. |
| 9,513,006 | B2 | 12/2016 | Krichtafovitch et al. |
| 9,562,681 | B2 | 2/2017 | Colannino et al. |
| 9,562,682 | B2 | 2/2017 | Karkow et al. |
| 9,574,767 | B2 | 2/2017 | Anderson et al. |
| 9,664,386 | B2 | 5/2017 | Krichtafovitch |
| 9,696,034 | B2 | 7/2017 | Krichtafovitch et al. |
| 9,702,547 | B2 | 7/2017 | Krichtafovitch et al. |
| 9,702,550 | B2 | 7/2017 | Colannino et al. |
| 9,732,958 | B2 | 8/2017 | Wiklof |
| 9,739,479 | B2 | 8/2017 | Krichtafovitch et al. |
| 9,746,180 | B2 | 8/2017 | Krichtafovitch et al. |
| 2002/0088442 | A1 | 7/2002 | Hansen et al. |
| 2002/0155403 | A1 | 10/2002 | Griffin et al. |
| 2003/0054313 | A1 | 3/2003 | Rattner et al. |
| 2005/0208442 | A1 | 9/2005 | Heiligers et al. |
| 2006/0141413 | A1 | 6/2006 | Masten et al. |
| 2007/0020567 | A1 | 1/2007 | Branston et al. |
| 2010/0178219 | A1 | 7/2010 | Verykios et al. |
| 2011/0076628 | A1 | 3/2011 | Miura et al. |
| 2012/0023950 | A1 | 2/2012 | Weeks et al. |
| 2012/0164590 | A1 | 6/2012 | Mach |
| 2012/0231398 | A1 | 9/2012 | Carpentier et al. |
| 2013/0071794 | A1 | 3/2013 | Colannino et al. |
| 2013/0230810 | A1 | 9/2013 | Goodson et al. |
| 2013/0260321 | A1 | 10/2013 | Colannino et al. |
| 2013/0323661 | A1 | 12/2013 | Goodson et al. |
| 2013/0333279 | A1 | 12/2013 | Osler et al. |
| 2013/0336352 | A1 | 12/2013 | Colannino et al. |
| 2014/0051030 | A1 | 2/2014 | Colannino et al. |
| 2014/0065558 | A1* | 3/2014 | Colannino ..... F23D 14/68 431/6 |
| 2014/0076212 | A1 | 3/2014 | Goodson et al. |
| 2014/0080070 | A1 | 3/2014 | Krichtafovitch et al. |
| 2014/0162195 | A1 | 6/2014 | Lee et al. |
| 2014/0162198 | A1 | 6/2014 | Krichtafovitch et al. |
| 2014/0170569 | A1 | 6/2014 | Anderson et al. |
| 2014/0170571 | A1 | 6/2014 | Casasanta, III et al. |
| 2014/0170575 | A1 | 6/2014 | Krichtafovitch |
| 2014/0170576 | A1 | 6/2014 | Colannino et al. |
| 2014/0196368 | A1 | 7/2014 | Wiklof |
| 2014/0208758 | A1 | 7/2014 | Breidenthal et al. |
| 2014/0212820 | A1 | 7/2014 | Colannino et al. |
| 2014/0216401 | A1 | 8/2014 | Colannino et al. |
| 2014/0227645 | A1 | 8/2014 | Krichtafovitch et al. |
| 2014/0227646 | A1 | 8/2014 | Krichtafovitch et al. |
| 2014/0227649 | A1 | 8/2014 | Krichtafovitch et al. |
| 2014/0255856 | A1 | 9/2014 | Colannino et al. |
| 2014/0272731 | A1 | 9/2014 | Breidenthal et al. |
| 2014/0287368 | A1 | 9/2014 | Krichtafovitch et al. |
| 2014/0295094 | A1 | 10/2014 | Casasanta, III |
| 2014/0335460 | A1 | 11/2014 | Wiklof et al. |
| 2015/0079524 | A1 | 3/2015 | Colannino et al. |
| 2015/0104748 | A1 | 4/2015 | Dumas et al. |
| 2015/0107260 | A1 | 4/2015 | Colannino et al. |
| 2015/0118629 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0219333 | A1 | 8/2015 | Colannino et al. |
| 2015/0226424 | A1 | 8/2015 | Breidenthal et al. |
| 2015/0276211 | A1 | 10/2015 | Colannino et al. |
| 2015/0276217 | A1 | 10/2015 | Karkow et al. |
| 2015/0316261 | A1 | 11/2015 | Karkow et al. |
| 2015/0330625 | A1 | 11/2015 | Karkow et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362177 | A1 | 12/2015 | Krichtafovitch et al. |
| 2015/0362178 | A1 | 12/2015 | Karkow et al. |
| 2015/0369476 | A1 | 12/2015 | Wiklof |
| 2015/0369477 | A1 | 12/2015 | Karkow et al. |
| 2016/0003471 | A1 | 1/2016 | Karkow et al. |
| 2016/0018103 | A1 | 1/2016 | Karkow et al. |
| 2016/0025333 | A1 | 1/2016 | Karkow et al. |
| 2016/0025374 | A1 | 1/2016 | Karkow et al. |
| 2016/0025380 | A1 | 1/2016 | Karkow et al. |
| 2016/0040872 | A1 | 2/2016 | Colannino et al. |
| 2016/0046524 | A1 | 2/2016 | Colannino et al. |
| 2016/0047542 | A1 | 2/2016 | Wiklof et al. |
| 2016/0091200 | A1 | 3/2016 | Colannino et al. |
| 2016/0123577 | A1 | 5/2016 | Dumas et al. |
| 2016/0138799 | A1 | 5/2016 | Colannino et al. |
| 2016/0161110 | A1 | 6/2016 | Krichtafovitch et al. |
| 2016/0161115 | A1 | 6/2016 | Krichtafovitch et al. |
| 2016/0215974 | A1 | 7/2016 | Wiklof |
| 2016/0230984 | A1 | 8/2016 | Colannino et al. |
| 2016/0238240 | A1 | 8/2016 | Colannino et al. |
| 2016/0238242 | A1 | 8/2016 | Karkow et al. |
| 2016/0238277 | A1 | 8/2016 | Colannino et al. |
| 2016/0238318 | A1 | 8/2016 | Colannino et al. |
| 2016/0245509 | A1 | 8/2016 | Karkow et al. |
| 2016/0273763 | A1 | 9/2016 | Colannino et al. |
| 2016/0273764 | A1 | 9/2016 | Colannino et al. |
| 2016/0276212 | A1 | 10/2016 | Rutkowski et al. |
| 2016/0290633 | A1 | 10/2016 | Cherpeske et al. |
| 2016/0290639 | A1 | 10/2016 | Karkow et al. |
| 2016/0298836 | A1 | 10/2016 | Colannino et al. |
| 2016/0298838 | A1 | 10/2016 | Karkow et al. |
| 2016/0298840 | A1 | 10/2016 | Karkow et al. |
| 2016/0305660 | A1 | 10/2016 | Colannino et al. |
| 2016/0348899 | A1 | 12/2016 | Karkow et al. |
| 2016/0348900 | A1 | 12/2016 | Colannino et al. |

(56) References Cited

U.S. PATENT DOCUMENTS

| | | | |
|---|---|---|---|
| 2016/0348901 | A1 | 12/2016 | Karkow et al. |
| 2016/0363315 | A1 | 12/2016 | Colannino et al. |
| 2017/0010019 | A1 | 1/2017 | Karkow et al. |
| 2017/0038063 | A1 | 2/2017 | Colannino et al. |
| 2017/0038064 | A1 | 2/2017 | Colannino et al. |
| 2017/0051913 | A1 | 2/2017 | Colannino et al. |
| 2017/0146232 | A1 | 5/2017 | Karkow et al. |
| 2017/0146233 | A1 | 5/2017 | Krichtafovitch |
| 2017/0146234 | A1 | 5/2017 | Krichtafovitch et al. |
| 2017/0184303 | A1 | 6/2017 | Colannino et al. |
| 2017/0191655 | A1 | 7/2017 | Colannino et al. |

FOREIGN PATENT DOCUMENTS

| | | |
|---|---|---|
| JP | 2006-275482 | 10/2006 |
| WO | WO 1995/000803 | 1/1995 |
| WO | WO 2013/181569 | 12/2013 |
| WO | WO 2014/197108 | 12/2014 |
| WO | WO 2015/089306 | 6/2015 |
| WO | WO 2015/123149 | 8/2015 |
| WO | WO 2015/123683 | 8/2015 |
| WO | WO 2016/133934 | 8/2016 |
| WO | WO 2016/133936 | 8/2016 |
| WO | WO 2016/134068 | 8/2016 |
| WO | WO 2016/140681 | 9/2016 |
| WO | WO 2016/141362 | 9/2016 |
| WO | WO 2017/048638 | 3/2017 |
| WO | WO 2017/124008 | 7/2017 |

OTHER PUBLICATIONS

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

Arnold Schwarzenegger, "A Low NOx Porous Ceramics Burner Performance Study," California Energy Commission Public Interest Energy Research Program, Dec. 2007, San Diego State University Foundation, p. 5.

* cited by examiner

PERFORATED FLAME HOLDER AND SYSTEM INCLUDING PROTECTION FROM ABRASIVE OR CORROSIVE FUEL

CROSS REFERENCE TO RELATED APPLICATIONS

The present application claims priority benefit from U.S. Provisional Patent Application No. 62/368,439, entitled "PERFORATED FLAME HOLDER AND SYSTEM INCLUDING PROTECTION FROM ABRASIVE FUEL," filed Jul. 29, 2016; which, to the extent not inconsistent with the disclosure herein, is incorporated by reference.

SUMMARY

According to an embodiment, a burner is configured to support combustion of a solid fuel. The burner includes a solid fuel source configured to output at least a stream of solid fuel particles and a perforated flame holder including a wear structure and a refractory structure. The flame holder is aligned for the stream of solid fuel particles to impinge upon the surface of wear structure and not impinge upon the refractory structure. The refractory structure is configured to hold a combustion reaction supported by the solid fuel. The wear structure can be configured to resist erosion from impingement by the solid fuel particles. Additionally or alternatively, the wear structure can be configured as a sacrificial structure aligned to protect the refractory structure.

According to an embodiment, a combustion system includes a perforated flame holder having an input face, an output face on a side opposite from, and (optionally) substantially parallel to the input face, and a plurality of perforations extending between the input face and the output face. The perforated flame holder further includes a wear surface disposed adjacent to the input face and configured to protect the perforated flame holder from erosion by an erosive or corrosive fuel. According to an embodiment, the wear surface is in contact with the input face. According to an embodiment, the wear surface is spaced apart from the input face.

According to an embodiment, the wear surface can protect the perforated flame holder from erosion by liquid fuel with particulates, soot particles, air laden with particulates, or other abrasive conditions associated with a combustion environment.

According to an embodiment, a perforated flame holder includes a plurality of flame holder sections, each having a respective plurality of perforations extending therethrough, the plurality of flame holder sections being arranged in a stack, with the pluralities of perforations of each of the plurality of flame holder sections aligned so as to form a single plurality of perforations extending through the entire stack of flame holder sections.

According to an embodiment, a method of manufacture includes forming a perforated flame holder having: an input face, an output face on a side of the flame holder opposite from the input face, and a plurality of perforations extending between the input face and the output face. In an embodiment, the perforated flame holder can be extruded through an extrusion die and extruded sections cut off the extrusion die. The method also includes forming an erosion shield positioned adjacent to the input face and configured to protect the perforated flame holder from erosion.

According to an embodiment, a method includes emitting, from a fuel nozzle, a fuel stream that includes entrained particles of solid fuel, receiving the fuel stream into an input face of a perforated flame holder, combusting the particles of solid fuel within perforations extending through the perforated flame holder, and limiting erosion of the perforated flame holder by the particles of solid fuel

DETAILED DESCRIPTION

Figure 1:
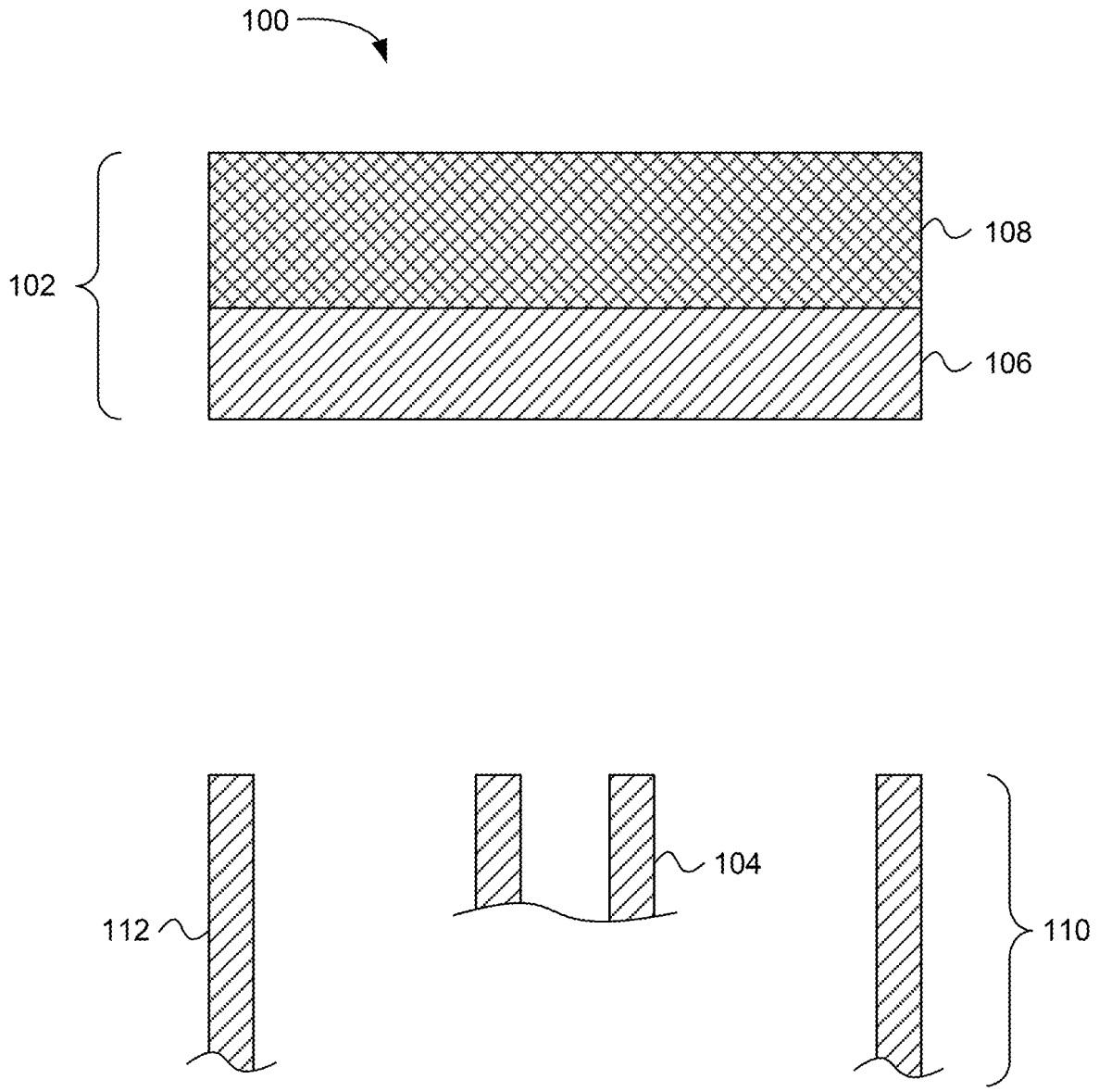
FIG. 1 is diagram of a burner including a perforated flame holder configured to support combustion of a solid fuel, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is diagram of a burner 100 configured to support combustion of a solid fuel, according to an embodiment. A solid fuel source 104 is configured to output at least a stream of solid fuel particles. A flame holder 102 including a wear structure 106 and a refractory structure 108 is aligned for the stream of solid fuel particles to impinge upon the wear structure 106 and not impinge upon the refractory structure 108. The refractory structure 108 is configured to hold a combustion reaction supported by the solid fuel. In an embodiment, the wear structure 106 is configured to resist erosion from impingement by the solid fuel particles. In another embodiment, the wear structure 106 is configured as a sacrificial structure aligned to protect the refractory structure 108.

In an embodiment, the refractory structure 108 forms a perforated flame holder structure configured to hold a combustion reaction supported by the solid fuel within a plurality of separate elongated apertures arranged parallel to a prevailing direction of the stream of solid fuel particles. In an embodiment, the refractory structure 108 is a perforated flame holder structure aligned to receive solid fuel particle flow and hold combustion within a plurality of perforations aligned parallel to the stream from the solid fuel source 104. Each of the plurality of perforations can be separated from others of the plurality of perforations by a wall having a first end arranged transverse to the solid fuel stream such that the first ends would be collectively subject to erosion if impacted by the solid fuel particles. The wear structure 106 can be formed as a grid arranged to protect the first ends of the walls on a leeward side of the flame holder 102, away from a prevailing solid fuel stream direction. For example, the plurality of wall first ends and the wear structure 106 can form mutually congruent shapes.

In an embodiment, the wear structure 106 is configured to resist erosion from impingement by the solid fuel particles. For example, the wear structure 106 can be formed from a high temperature steel and/or superalloy. In another embodiment, the wear structure 106 is configured as a sacrificial structure aligned to protect the refractory structure 108.

The solid fuel source 104 can be formed as a fuel and combustion air assembly 110. The solid fuel particles can be at least partially entrained by combustion air. Looking at the solid fuel source 104 in another way, the solid fuel source 104 and a combustion air source 112 can be an integrated solid fuel and combustion air assembly 110.

According to an embodiment the wear structure 106 can include a thermal barrier coating applied to an input face of the refractory structure 108. The thermal barrier coating can be applied to the input face of the refractory structure 108 by plasma spraying the thermal barrier coating onto the input face. The thermal barrier coating can be selected to have thermal characteristics that match the thermal characteristics of the refractory structure 108.

Figure 2:
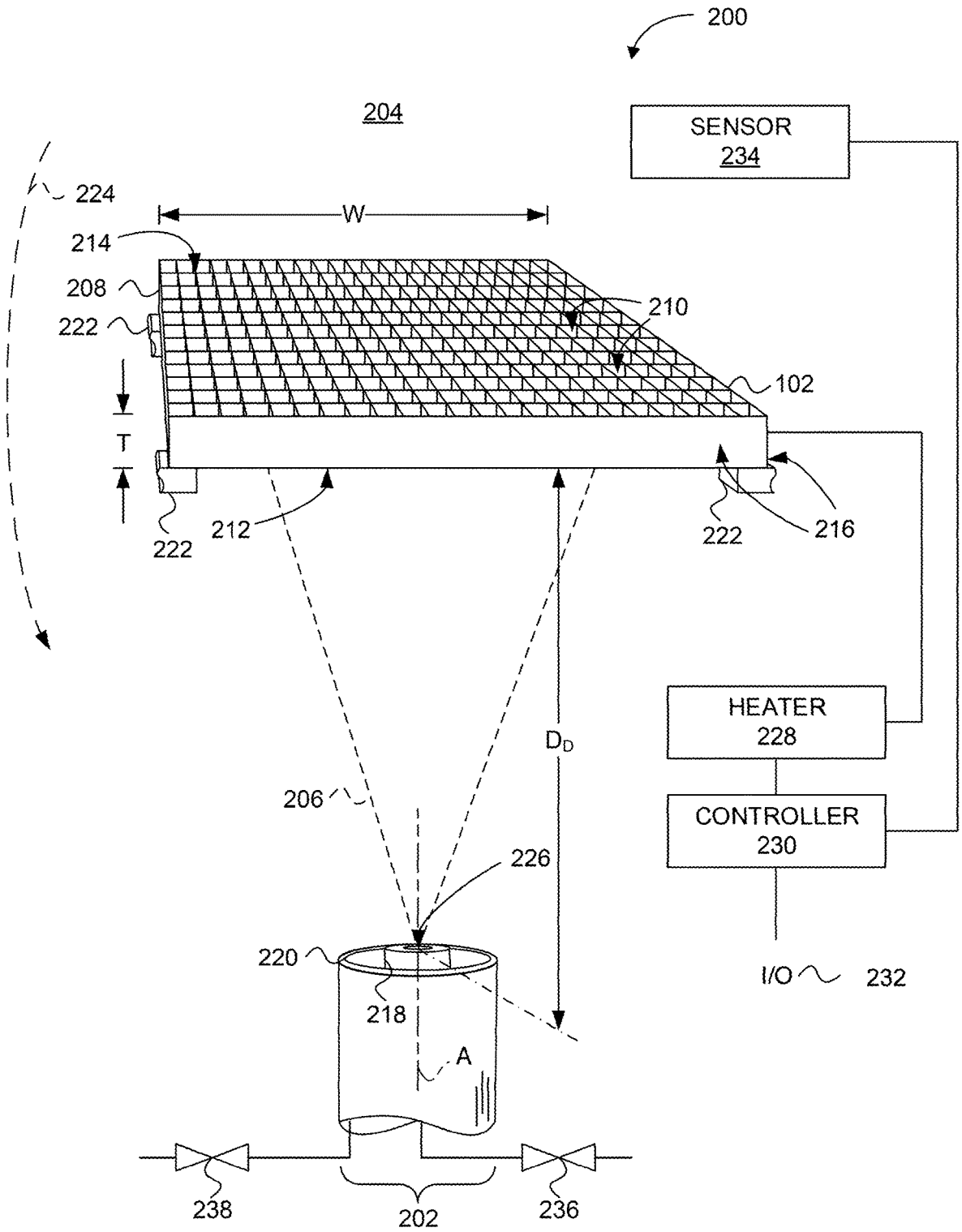
FIG. 2 is a simplified perspective view of a burner system including a perforated flame holder, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, and porous reaction holder shall be considered synonymous unless further definition is provided. Experiments performed by the inventors have shown that perforated flame holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
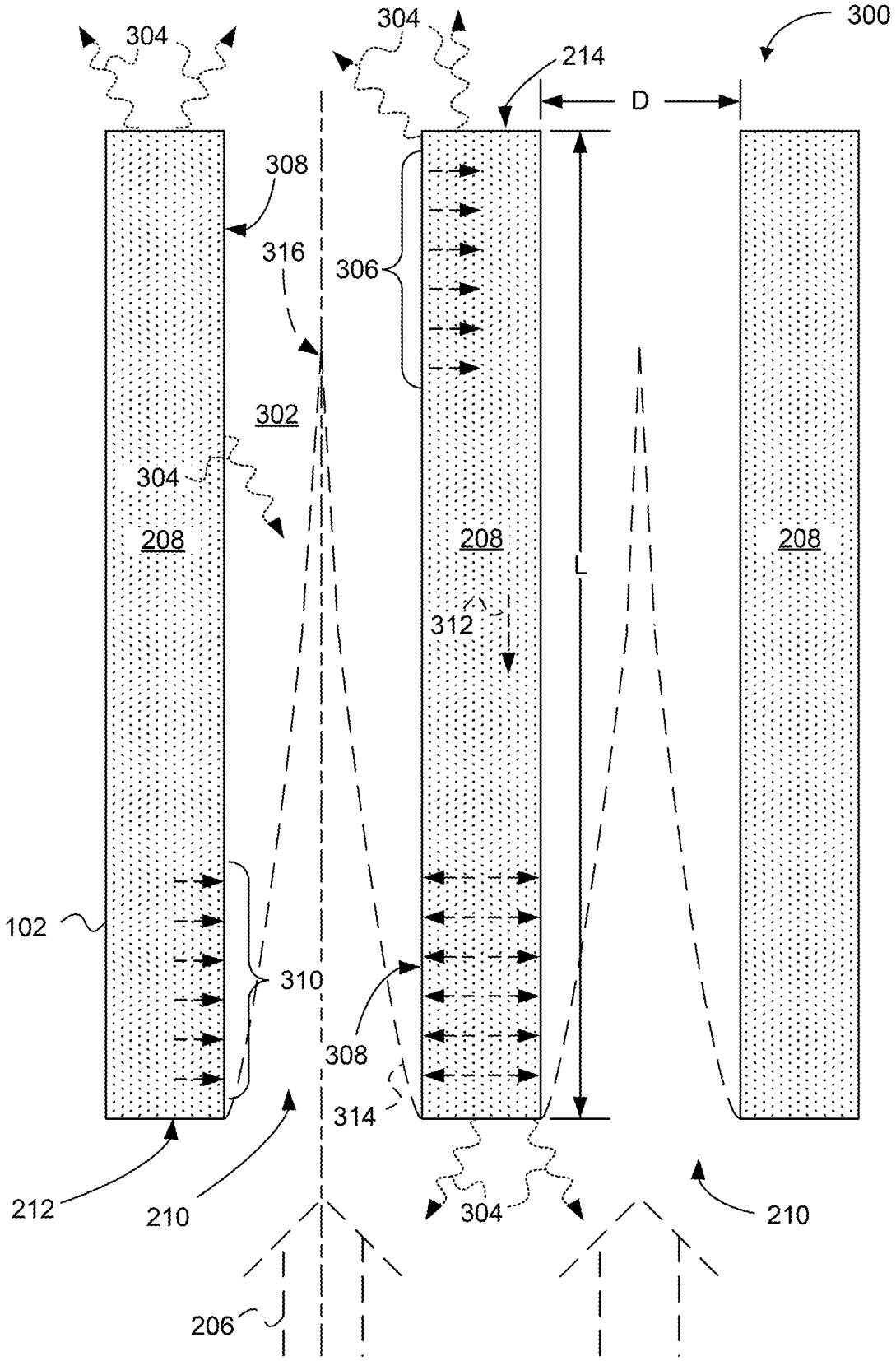
FIG. 3 is side sectional diagram of a portion of the perforated flame holder of FIG. 2, according to an embodiment.

FIG. 3 is side sectional diagram 300 of a portion of the perforated flame holder 102 of FIG. 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

In addition to a solid fuel, the fuel can include a fuel mixture including hydrogen, a hydrocarbon gas, a vaporized hydrocarbon liquid, or an atomized hydrocarbon liquid. The fuel can be a single species or can include a mixture of solid fuel(s) with gas(es), vapor(s), and/or atomized liquid(s). For example in a process heater application, the fuel can include coal with a fuel gas or byproducts from the process that include CO, hydrogen ($H_2$), and methane ($CH_4$). In another application the fuel can include a solid fuel plus natural gas (mostly $CH_4$) or propane ($C_3H_8$). In another application, the fuel can include #2 fuel oil or #6 fuel oil and a solid fuel. The solid fuel can include various pulverized, chopped, or powdered fuels including coal, coke, wood (e.g., hog fuel), industrial waste, municipal waste, etc. Dual fuel applications and flexible fuel applications are similarly contemplated by the inventors. The oxidant can include oxygen carried by air and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat output by the combustion reaction 302 may be output between the input face 212 and the output face 214 of the perforated flame holder 102. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" wherein a visible flame momentarily ignites in a region lying between the input face 212 of the perforated flame holder 102 and the fuel source 218, within the dilution region $D_D$. Such transient huffing is generally short in duration such that, on a time-averaged basis, a majority of combustion occurs within the perforations 210 of the perforated flame holder 102, between the input face 212 and the output face 214. In still other instances, the inventors have noted apparent combustion occurring above the output face 214 of the perforated flame holder 102, but still a majority of combustion occurred within the perforated flame holder 102 as evidenced by the continued visible glow (a visible wavelength tail of blackbody radiation) from the perforated flame holder 102.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as thermal radiation, infrared radiation, radiant heat, heat radiation, etc. are to be construed as being substantially synonymous, unless further definition is provided. Specifically, such terms refer to blackbody radiation of electromagnetic energy, primarily in infrared wavelengths.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the (exothermic) combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold heat from the combustion reaction 302 in an amount corresponding to the heat capacity times temperature rise, and transfer the heat from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that both radiation and conduction heat transfer mechanisms may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to occur within thermal boundary layers 314 formed adjacent to walls 308 of the perforations 210. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g. the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that defines the ends of the perforations 210. At some point, the combustion reaction 302 causes the flowing gas (and plasma) to output more heat to the body 208 than it receives from the body 208. The heat is received at the heat receiving region 306, is held by the body 208, and is transported to the heat output region 310 nearer to the input face 212, where the heat recycles into the cool reactants (and any included diluent) to raise them to the combustion temperature.

In an embodiment, the plurality of perforations 210 are each characterized by a length L defined as a reaction fluid propagation path length between the input face 212 and the output face 214 of the perforated flame holder 102. The reaction fluid includes the fuel and oxidant mixture 206 (optionally including nitrogen, flue gas, and/or other "non-reactive" species), reaction intermediates (including transition states in a plasma that characterizes the combustion reaction), and reaction products.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 formed adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen.

The perforated flame holder 102 can be held by a perforated flame holder support structure 222 configured to hold the perforated flame holder 102 a distance $D_D$ away from the fuel nozzle 218. The fuel nozzle 218 can be configured to emit a fuel jet selected to entrain the oxidant to form the fuel and oxidant mixture 206 as the fuel jet and oxidant travel along a path to the perforated flame holder 102 through a dilution distance $D_D$ between the fuel nozzle 218 and the perforated flame holder 102. Additionally or alternatively (particularly when a blower is used to deliver oxidant combustion air), the oxidant or combustion air source can be configured to entrain the fuel and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through a dilution distance $D_D$ between the fuel nozzle 218 and the input face 212 of the perforated flame holder 102.

The fuel nozzle 218 can be configured to emit the fuel through one or more fuel orifices 226 having a dimension that is referred to as "nozzle diameter." The perforated flame holder support structure 222 can support the perforated flame holder 102 to receive the fuel and oxidant mixture 206 at a distance $D_D$ away from the fuel nozzle 218 greater than 20 times the nozzle diameter. In another embodiment, the perforated flame holder 102 is disposed to receive the fuel and oxidant mixture 206 at a distance $D_D$ away from the fuel nozzle 218 between 100 times and 1100 times the nozzle diameter. Preferably, the perforated flame holder support structure 222 is configured to hold the perforated flame holder 102 about 200 times the nozzle diameter or more away from the fuel nozzle 218. When the fuel and oxidant mixture 206 travels about 200 times the nozzle diameter or more, the mixture 206 is sufficiently homogenized to cause the combustion reaction 302 to output minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an air channel configured to output combustion air into the premix chamber. A flame arrestor can be disposed between the premix fuel and oxidant source and the perforated flame holder 102 and be configured to prevent flame flashback into the premix fuel and oxidant source.

The combustion air source, whether configured for entrainment in the combustion volume 204 or for premixing can include a blower configured to force air through the fuel and air source 202.

The support structure 222 can be configured to support the perforated flame holder 102 from a floor or wall (not shown) of the combustion volume 204, for example. In another embodiment, the support structure 222 supports the perforated flame holder 102 from the fuel and oxidant source 202. Alternatively, the support structure 222 can suspend the perforated flame holder 102 from an overhead structure (such as a flue, in the case of an up-fired system). The support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times a thickness dimension T between the input face 212 and the output face 214 of the perforated flame holder 102.

In an embodiment, the perforated flame holder 102 can have a width dimension W less than a width of the combustion volume 204. This can allow the flue gas circulation path 224 from above to below the perforated flame holder 102 to lie between the peripheral surface 216 of the perforated flame holder 102 and the combustion volume wall (not shown).

Referring again to both FIGS. 2 and 3, the perforations 210 can include elongated squares, each of the elongated squares has a transverse dimension D between opposing sides of the squares. In another embodiment, the perforations 210 can include elongated hexagons, each of the elongated hexagons has a transverse dimension D between opposing sides of the hexagons. In another embodiment, the perforations 210 can include hollow cylinders, each of the hollow cylinders has a transverse dimension D corresponding to a diameter of the cylinders. In another embodiment, the perforations 210 can include truncated cones, each of the truncated cones has a transverse dimension D that is rotationally symmetrical about a length axis that extends from the input face 212 to the output face 214. The perforations 210 can each have a lateral dimension D equal to or greater than a quenching distance of the fuel based on standard reference conditions.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including body 208 and perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed from mullite or cordierite. Additionally or alternatively, the perforated flame holder body 208 can include a metal superalloy such as Inconel or Hastelloy. The perforated flame holder body 208 can define a honeycomb.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 208 can be one piece or can be formed from a plurality of sections.

In another embodiment, which is not necessarily preferred, the perforated flame holder 102 may be formed from reticulated fibers formed from an extruded ceramic material. The term "reticulated fibers" refers to a netlike structure.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g. Super Raschig Rings) that may be held together by a metal cage.

The inventors contemplate various explanations for why burner systems including the perforated flame holder 102 provide such clean combustion.

In one aspect, the perforated flame holder 102 acts as a heat source to maintain a combustion reaction 302 even under conditions where a combustion reaction 302 would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream—lower combustion limit defines the lowest concentration of fuel at which a fuel/air mixture will burn when exposed to a momentary ignition source under normal atmospheric pressure and an ambient temperature of 25° C. (77° F.).

According to one interpretation, the fuel and oxidant mixtures 206 supported by the perforated flame holder 102 may be more fuel-lean than mixtures that would provide stable combustion in a conventional burner. Combustion near a lower combustion limit of fuel generally burn at a lower adiabatic flame temperature than mixtures near the center of the lean-to-rich combustion limit range. Lower flame temperatures generally evolve a lower concentration of oxides of nitrogen (NOx) than higher flame temperatures. In conventional flames, too-lean combustion is generally associated with high CO concentration at the stack. In contrast, the perforated flame holder 102 and systems including the perforated flame holder 102 described herein were found to provide substantially complete combustion of CO (single digit ppm down to undetectable, depending on experimental conditions), while supporting low NOx. In some embodiments, the inventors achieved stable combustion at what was understood to be very lean mixtures (that nevertheless produced only about 3% or lower measured $O_2$ concentration at the stack). Moreover, the inventors believe perforation walls 308 may act as a heat sink for the combustion fluid. This effect may alternatively or additionally reduce combustion temperature.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Since CO oxidation is a relatively slow reaction, the time for passage through the perforated flame holder 102 (perhaps plus time passing toward the flue from the perforated flame holder 102) is apparently sufficient and at sufficiently elevated temperature, in view of the very low measured (experimental and full scale) CO concentrations, for oxidation of CO to carbon dioxide ($CO_2$).

Figure 4:
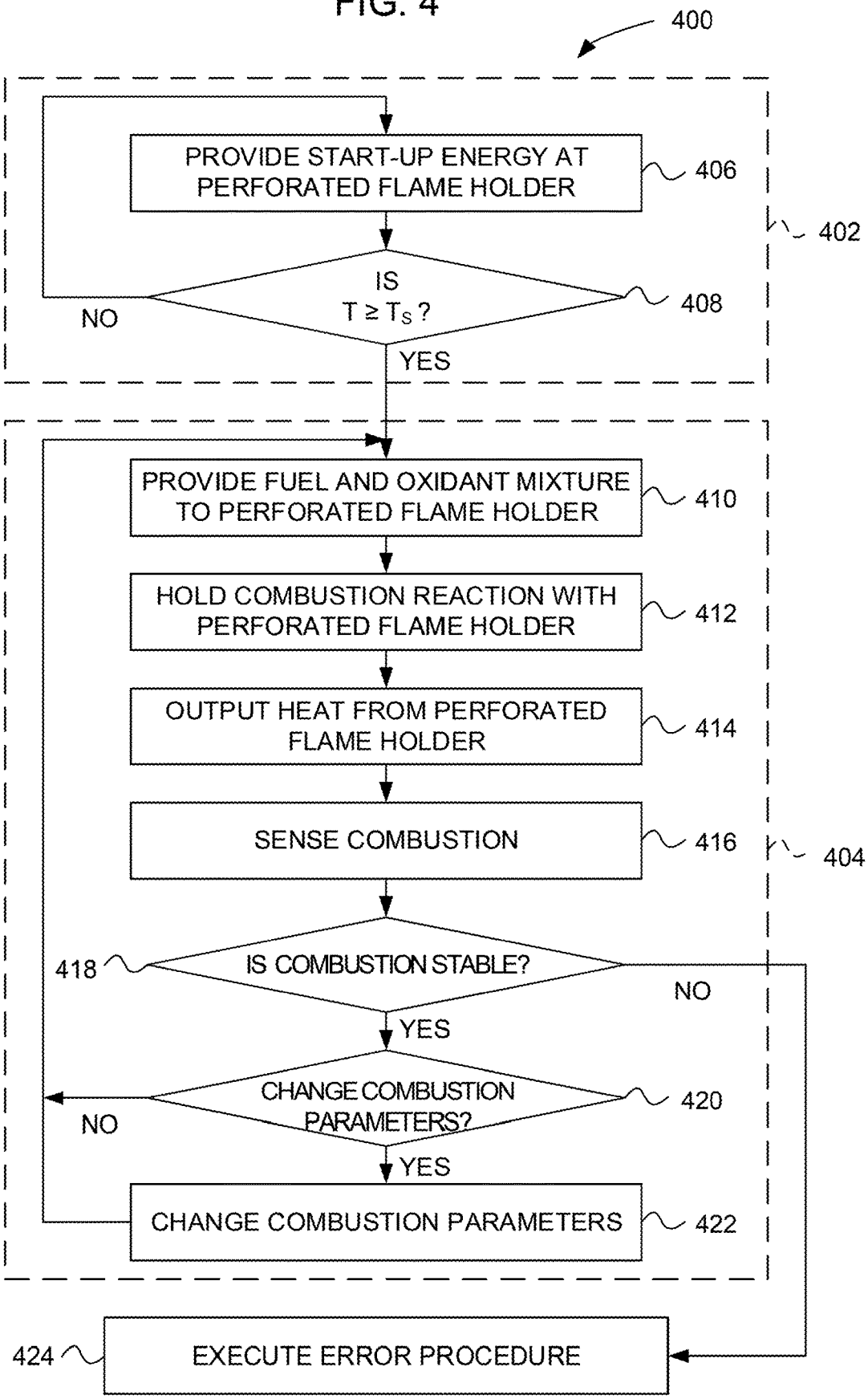
FIG. 4 is a flow chart showing a method for operating a burner system including the perforated flame holder of FIGS. 2 and 3, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from step 408, a fuel and oxidant mixture is provided to the perforated flame holder, as shown in step 410. The fuel and oxidant may be provided by a fuel and oxidant source that includes a separate fuel nozzle and combustion air source, for example. In this approach, the fuel and combustion air are output in one or more directions selected to cause the fuel and combustion air mixture to be received by an input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, and/or other known combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include a fuel nozzle 218 configured to emit a fuel stream and an air source 220 configured to output combustion air adjacent to the fuel stream. The fuel nozzle 218 and air source 220 can be configured to output the fuel stream to be progressively diluted by the combustion air. The perforated flame holder 102 can be disposed to receive a diluted fuel and air mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively rich fuel and air mixture that is stable without stabilization provided by the heated perforated flame holder 102.

The burner system 200 can further include a controller 230 operatively coupled to the heater 228 and to a data interface 232. For example, the controller 230 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater 228 can be configured to heat up the perforated flame holder 102 to an operating temperature. The heater 228 can further include a power supply and a switch operable, under control of the controller 230, to selectively couple the power supply to the electrical resistance heater.

An electrical resistance heater 228 can be formed in various ways. For example, the electrical resistance heater 228 can be formed from KANTHAL wire (available from Sandvik Materials Technology division of Sandvik AB of Hallstahammar, Sweden) threaded through at least a portion of the perforations 210 defined by the perforated flame holder body 208. Alternatively, the heater 228 can include an inductive heater, a high energy (e.g. microwave or laser) beam heater, a frictional heater, or other types of heating technologies.

Other forms of start-up apparatuses are contemplated. For example, the heater 228 can include an electrical discharge igniter or hot surface igniter configured to output a pulsed ignition to the air and fuel. Additionally, or alternatively, a start-up apparatus can include a pilot flame apparatus disposed to ignite a fuel and oxidant mixture 206 that would otherwise enter the perforated flame holder 102. An electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the control circuit 230. The sensor 234 can include a heat sensor configured to detect infrared radiation or a temperature of the perforated flame holder 102. The control circuit 230 can be configured to control the heating apparatus 228 responsive to input from the sensor 234. Optionally, a fuel control valve 236 can be operatively coupled to the controller 230 and configured to control a flow of fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction held by the perforated flame holder 102. The fuel control valve 236 can be configured to control a flow of fuel from a fuel source to the fuel and oxidant source 202. The controller 230 can be configured to control the fuel control valve 236 responsive to input from the combustion sensor 234. The controller 230 can be configured to control the fuel control valve 236 and/or oxidant blower or damper 238 to control a preheat flame type of heater 228 to heat the perforated flame holder 102 to an operating temperature. The controller 230 can similarly control the fuel control valve 236 and/or the oxidant blower or damper 238 to change the fuel and oxidant mixture 206 flow responsive to a heat demand change received as data via the data interface 232.

Each of FIGS. 5A-5D is a diagrammatic sectional view, according to a respective embodiment, of a small portion of a perforated flame holder corresponding to the portion of the flame holder 102 in FIG. 2.

Figure 5A:
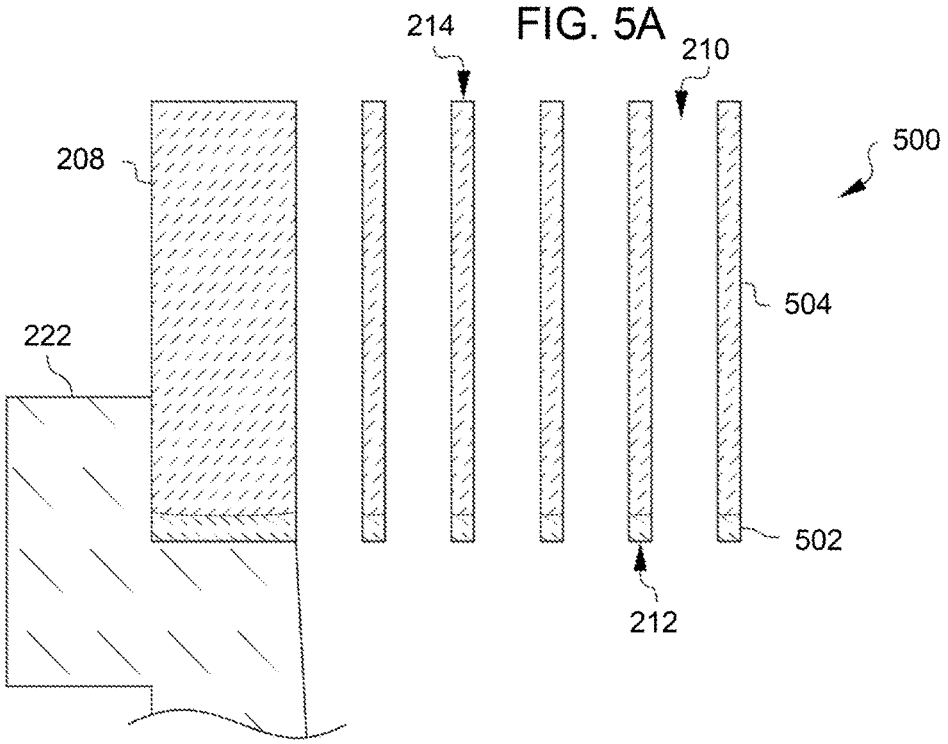
FIGS. 5A-5D are diagrammatic sectional views, according to respective embodiments, of a small portion of a perforated flame holder.

In the embodiment depicted in FIG. 5A, a detail of a perforated flame holder 500 is shown, having a first portion 502 that includes a material having a selected erosion resistance, and a second portion 504 that includes a material having selected thermal characteristics. In the embodiment shown, the first portion 502 is a ceramic material having properties selected for resistance to abrasion and erosion. Such properties can include, for example, hardness, resilience, toughness, cohesion, etc. The first portion 502 can be selected on the basis of its fracture toughness such that the first portion 502 is highly resistant to being fractured. The second portion 504 is a ceramic material having properties selected for efficient and economic operation as a flame holder 500. Such properties can include, for example, thermal conductance, thermal transmittance, thermal capacity, emissivity, etc. The first portion 502 represents a small percentage of the total mass of the perforated flame holder 500, but includes the input face 212 of the flame holder 500. Thus, during operation, the first portion 502 receives most of the impact of the powdered fuel in the fuel stream 206, and acts as an erosion shield, to protect the second portion 504 of the flame holder 500 from the abrasive fuel particles.

According to an embodiment, the perforated flame holder 500 is manufactured in a casting process, in which a first molding compound, formulated to provide the selected properties of the first portion 502 of the flame holder 500, is introduced into a mold and evenly distributed over the bottom of the mold, after which a second molding compound, formulated to provide the selected properties of the second portion 504, is introduced into the same mold, and the casting is processed in a normal fashion. In this way, the input face 212 of the flame holder 500 is formed from the first molding compound, and has the properties selected for the first portion 502, while the majority of the flame holder 500 is formed from the second molding compound, having the properties selected for the second portion 504 of the flame holder 500. According to an alternate embodiment, the order in which the first and second molding compounds are introduced into the mold is reversed, so that the input face 212 of the flame holder 500 is formed at the top of the mold.

The molding compounds can be in the form of ceramic powder, slip, clay, etc., according to the type of casting process employed.

Figure 5B:
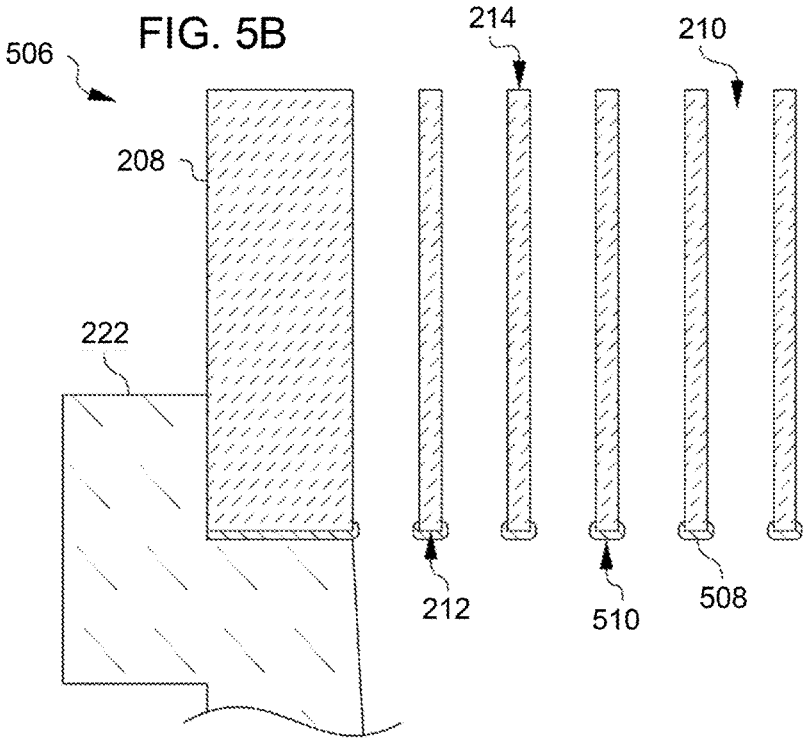

FIG. 5B is a detail of a perforated flame holder 506, according to another embodiment. The flame holder 506 includes a flame holder body 208 that is substantially similar to the perforated flame holder 102 described with reference to FIG. 2. Additionally, an erosion shield 508 is attached to the input face 212 of the body 208, and effectively defines a protective input face 510. The erosion shield 508 can be formed of a metal alloy, a ceramic, or other material having characteristics selected to resist abrasion and erosion at the operating temperatures of the flame holder 506.

The erosion shield 508 can be manufactured separately from the flame holder body 208 and subsequently attached, or can be formed on the body 208. For example, in embodiments in which the erosion shield 508 is made from a ceramic material, the shield can be cast separately, or the input face 212 of the flame holder body 208 can be dipped in a ceramic slurry and the body 208 and shield 508 subsequently sintered. In embodiments in which the erosion shield 508 is made of a metal alloy, the shield can be stamped, blanked, or machined (and, where applicable, hardened), then attached to the flame holder body 208.

According to an alternative process, the shield 508 is formed on the body 208 using a plating process. According to an embodiment, a seed layer is applied to the input face 212 by dipping or spraying, for example, then the shield 508 is plated to a selected thickness over the seed layer. According to another embodiment, a resist layer is formed on the flame holder body 208, then mechanically removed from the input face 212, such as in a polishing or lapping process. A seed layer is then deposited in a chemical vapor deposition process, and the erosion shield 508 is subsequently plated over the shield layer to the selected thickness.

Figure 5C:
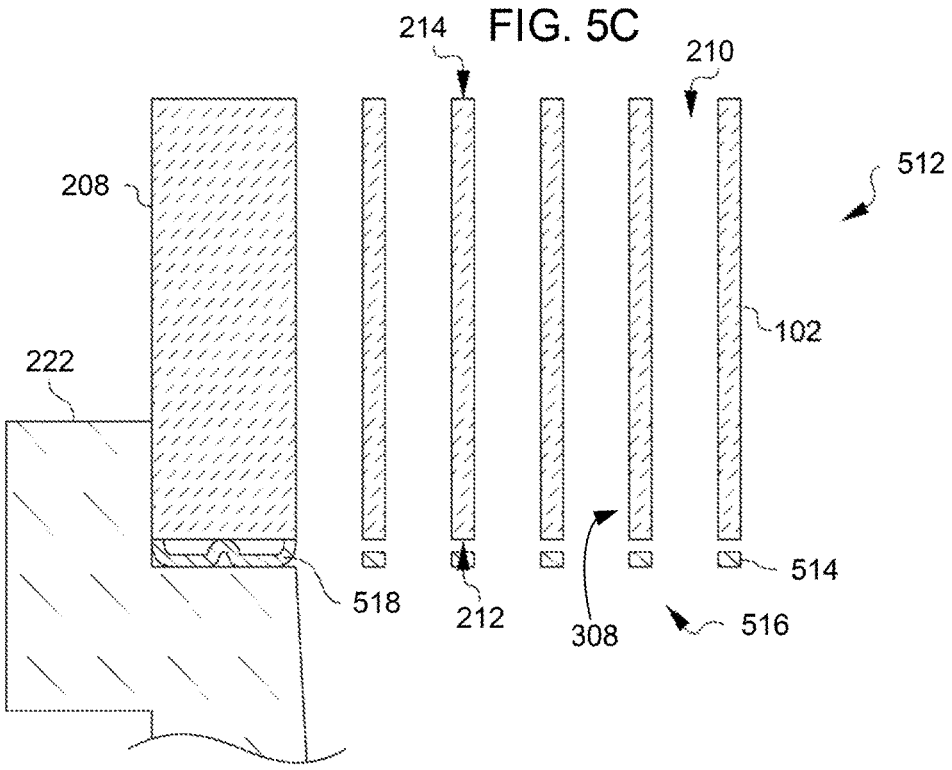

FIG. 5C shows a flame holder assembly 512, according to an embodiment, that includes a perforated flame holder 102 and an erosion shield 514. The erosion shield 514 is provided separately from the flame holder 102, and is positioned under the perforated flame holder 102 in the flame holder support structure 222. The erosion shield 514 is in the form of a grid 516 that corresponds, in pitch and dimensions, to the grid pattern formed by the leading edges of the perforation walls 308 at the input face 212 of the perforated flame holder 102. Accordingly, during operation, the majority of the impacts by fuel particles are born by the erosion shield 514, thereby reducing the rate at which the flame holder 102 is eroded.

The grid 516 is supported by a grid frame 518 that is received by the flame holder support structure 222 and that in turn supports the flame holder 102. The grid frame 518 is shaped so as to make minimal contact with the flame holder 102 and is configured to support the grid 516 of the erosion shield 514 spaced a short distance away from the input face 212 of the flame holder 102.

During operation of the flame holder assembly 512, fluid components of the fuel stream 206 cool the erosion shield 514 by convection as they flow through the grid 516. Optionally, the grid 516 and/or the input face 212 can be treated to reduce emissivity, so as to limit heat transfer by radiation. Optionally, minimized contact area between the grid frame 518 and the flame holder 102 and the space between the grid 516 and the input face 212 can serve to reduce the amount of heat that is transmitted by conduction from the flame holder body 208 to the erosion shield 514.

According to another embodiment, the material of the erosion shield 514 is selected to be at least partially transparent to the infrared wavelengths at which heat is radiated by the flame holder body 208, further reducing the thermal energy absorbed by the shield 514.

By reducing, to the extent possible, the maximum temperature of the erosion shield 514 during normal operation, the available choices of materials is increased, enabling the selection of materials that may be more resistant to erosion than materials that would be capable of withstanding the normal operating temperature of the flame holder 102, or whose erosion resistance is greater at lower temperatures.

According to an embodiment, the erosion shield 514 is made of a metal alloy in a stamping or blanking operation. According to another embodiment, the erosion shield 514 is ceramic, made in accordance with known processes, such as by casting, for example. According to another embodiment, the erosion shield 514 is made of synthetic sapphire, formed, for example, in a hot-isostatic-press process. A sapphire erosion shield provides the benefits of exceptional hardness and resistance to erosion, as well as a high degree of transparency to infrared radiation.

Figure 5D:
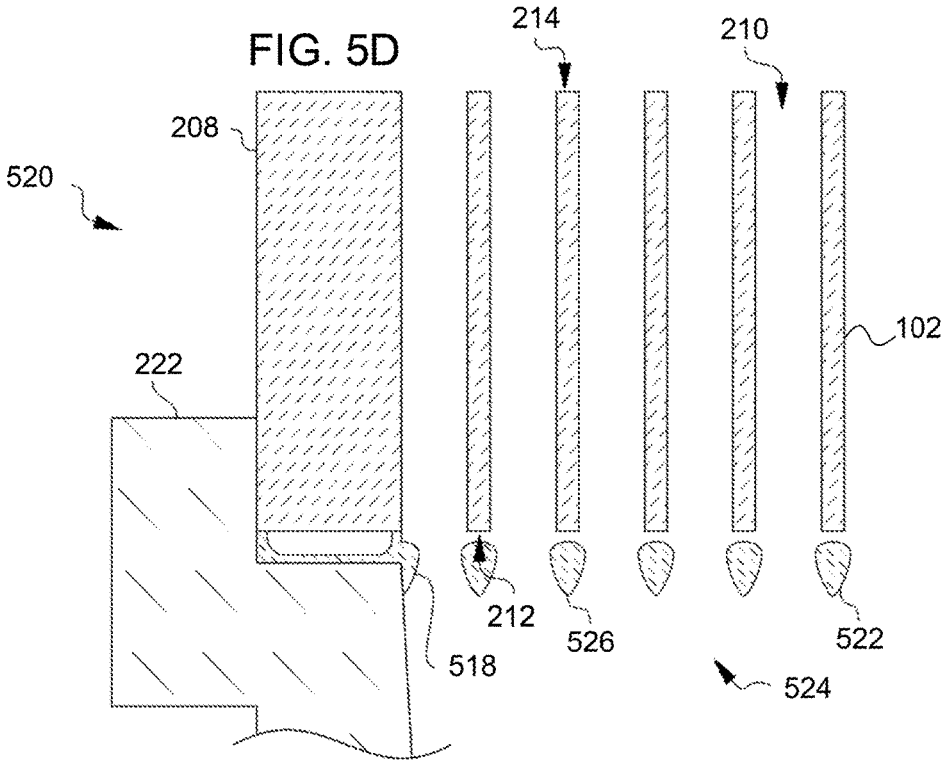

FIG. 5D shows a flame holder assembly 520, according to an embodiment, that includes a perforated flame holder 102 and an erosion shield 522. In many respects, the erosion shield 522 is similar to the erosion shield 514 described with reference to FIG. 5C. However, the erosion shield 522 includes a grid 524 having grid segments 526 that are aerodynamically shaped and configured to direct the flow of the fuel stream 206 smoothly toward the perforations 210, thereby reducing the effect of the abrasive fuel particles entrained in the fuel stream 206.

In embodiments that include an erosion shield that is separate—or separable—from a flame holder body 208, the erosion shell can be replaced periodically, as it wears, to maintain a desired degree of erosion protection for the flame holder 102.

Referring again to FIG. 2, it can be seen that in the pictured embodiment, the fuel stream 206 expands outward from a longitudinal axis A of the nozzle 218 in a conical pattern. Thus, as the fuel particles entrained in the fuel stream 206 reach the input face 212 of the flame holder 102, some portion of the fuel particles may strike interior faces of the perforation walls 308 (see FIG. 3) behind the leading edges of the perforation walls 308.

Figure 6:
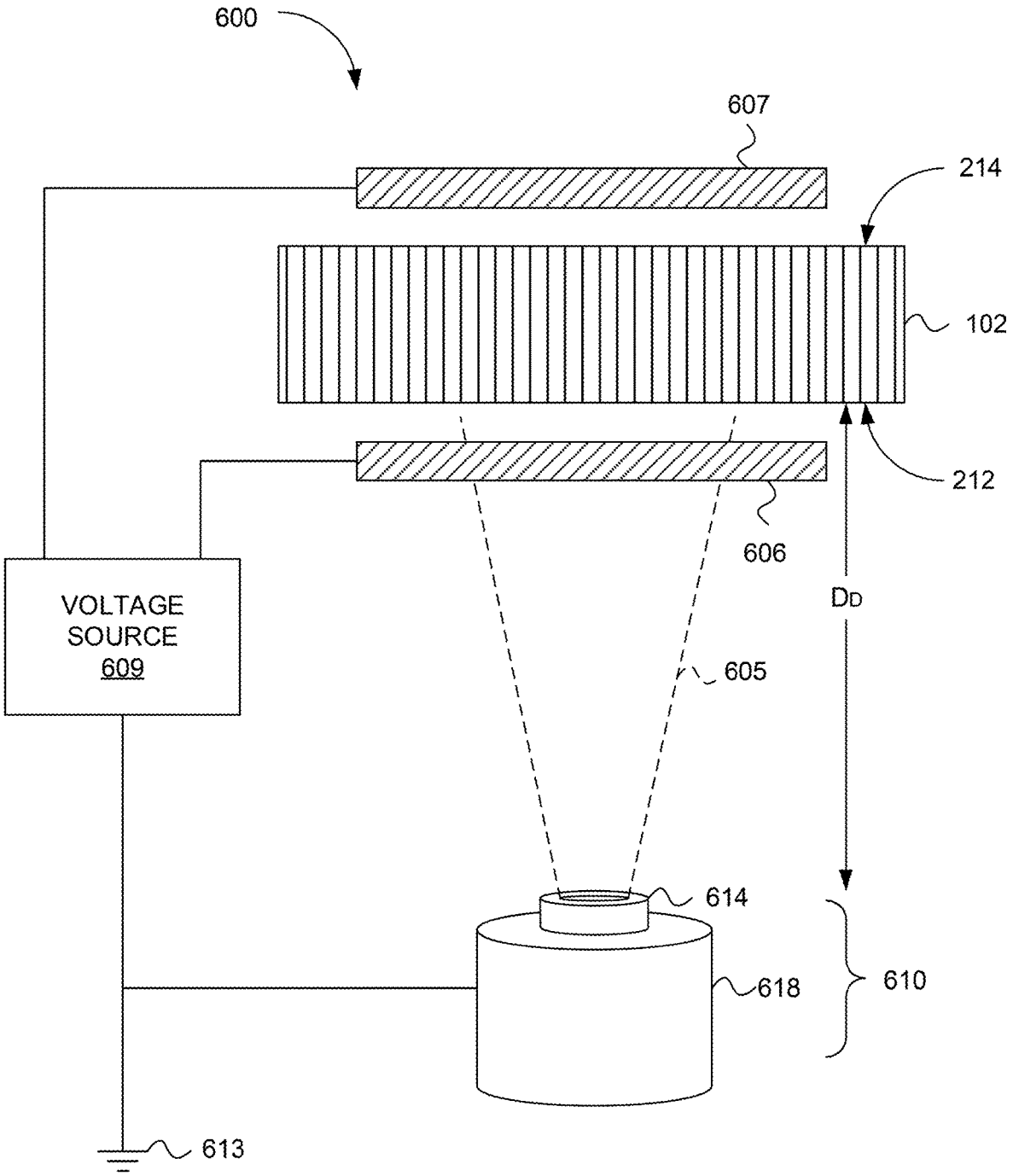
FIG. 6 is a diagram of a combustion system including an electrically conductive wear structure coupled to a voltage source, according to an embodiment.

FIG. 6 is a diagram of a combustion system 600, according to an embodiment. A solid fuel and oxidant source 610 is configured to emit solid fuel and oxidant 605. A perforated flame holder 102 is aligned to receive the solid fuel and oxidant 605 and is configured to hold a combustion reaction 302 supported by the solid fuel and oxidant 605. A counter wear structure 606 is positioned between the solid fuel and oxidant source 610 and the perforated flame holder 102. A voltage source 609 and an electrode 110 are operatively communicably coupled to the counter wear structure 606.

According to an embodiment, the wear structure 606 is positioned to protect the input surface 212 of the perforated flame holder 102 from impact by the solid fuel 605. Thus, according to an embodiment, the wear structure 606 is an erosion guard configured to protect the input surface 212 from being eroded by the solid fuel particles. The wear structure 606 includes apertures that enable the solid fuel to pass through the wear structure 606 into the perforations of the perforated flame holder 102. The wear structure 606 can function to protect the perforated flame holder 102 and can include similar materials and structures as the wear structures and erosion guards described with relation to FIGS. 1, 5A-8.

According to an embodiment, the wear structure 606 is electrically conductive such that the wear structure 606 can be an electrode capable of exerting an electrical influence on the solid fuel 605, the combustion reaction 302, and/or the perforated flame holder 102. The wear structure 606 can include a refractory metal that is resistant to erosion by the solid fuel 605 and that is electrically conductive. Alternatively, the wear structure 606 can include a ceramic material that becomes electrically conductive at high temperatures.

According to an embodiment, the combustion system 600 includes a counter electrode 607 positioned adjacent to the output surface 214 of the perforated flame holder 102. The counter electrode 607 is configured, together with the wear structure 606, to electrically influence one or more of the solid fuel 605, the combustion reaction 302 of the solid fuel and oxidant 605, and the perforated flame holder 102.

According to an embodiment, the wear structure 606 and the counter electrode 607 are communicably coupled to the voltage source 609. The voltage source 609 is configured to apply a voltage between the wear structure 606 and the counter electrode 607. The voltage source 609, the wear structure 606, and the counter electrode 607 collectively exert an electrical influence on one or more of the combustion reaction 302, the solid fuel 605, and the perforated flame holder 102 when the voltage source 609 applies the voltage between the wear structure 606 and the counter electrode 607.

According to an embodiment, the voltage applied between the wear structure 606 and the counter electrode 607 by the voltage source 609 can include a DC voltage, an AC voltage, a voltage waveform, or any other suitable voltage signal.

According to an embodiment, the wear structure 606 and the counter electrode 607 are configured to generate a plasma within the perforations of the perforated flame holder 102 when the voltage source 609 applies the voltage between the wear structure 606 and the counter electrode 607. When the voltage source 609 applies the voltage between the wear structure 606 and the counter electrode 607, a plasma is generated from the gases within the perforations of the perforated flame holder 102. The plasma can assist in ensuring that the solid fuel and the oxidant 605 more completely combust. Additionally, the plasma can assist in heating the perforated flame holder 102.

According to an embodiment, the perforated flame holder 102 is configured to receive heat from the combustion reaction and to output heat to the solid fuel and oxidant 605. In receiving heat from the combustion reaction 302 and outputting heat to the fuel and oxidant mixture 206, the perforated flame holder 102 stabilizes the combustion reaction 302. According to embodiments, the perforated flame holder 102 is configured to extend a stability limit of the solid fuel and oxidant 605 supporting the combustion reaction 302. It is believed that this operates by ensuring sufficient heat transfer to the solid fuel and oxidant 605 to maintain combustion, even of a solid fuel and oxidant mixture that is too (fuel-) lean to support stable combustion in a conventional flame.

According to an embodiment, the voltage source 609 is configured to output a voltage selected to cause the wear structure 606 and the counter electrode 607 to apply an electric field to the combustion reaction 302 (supported by the perforated flame holder 102) sufficient to broaden a stability and/or flammability limit of the solid fuel and oxidant 605. Thus, the combustion reaction 302 receives combined effects of stability and/or flammability limit broadening from both the heat transfer effects of the perforated flame holder 102, and from the electric field effects from the voltage source 609 and electrode 110. The combined effects support cleaner combustion than can normally be supported by a conventional flame. In an embodiment, the combined effects support cleaner combustion than can normally be supported by either individual effect alone. "Cleaner combustion" refers to reduced output of undesirable reaction products such as oxides of nitrogen (NOx) and carbon monoxide (CO).

Generally, the inventors have found that the high applied voltages are necessary and sufficient to affect the combustion reaction 302. In an embodiment, the voltage source 609 is configured to output a high voltage greater than 1000 volts to the electrode 110. In a preferred embodiment, the voltage source 609 is configured to output at least 10,000 volts to the electrode 607.

Various electrode configurations are contemplated by the inventors.

In the embodiment shown in FIG. 6, the wear structure 606 is disposed adjacent to the perforated flame holder 102. For example, the wear structure 606 can include a metal screen disposed adjacent to the perforated flame holder 102. Additionally, or alternatively, the wear structure 606 can include a conductive material disposed on a surface of the perforated flame holder 102. Additionally or alternatively, the wear structure 606 includes a conductor disposed within the volume bounded by the perforated flame holder 102. Approaches for coupling electrodes with a structure in a combustion environment are described more fully in PCT Patent Application No. PCT/US2014/031969, entitled "ELECTRICALLY CONTROLLED COMBUSTION FLUID FLOW," filed Mar. 27, 2014; which, to the extent not inconsistent with the disclosure herein, is incorporated by reference in its entirety.

In embodiments where there is no explicit second electrode, the wear structure 606 can form an electric field with any grounded surface nearby. In one embodiment, for example, the fuel and oxidant source 610 can be in continuity with a voltage ground 613, and the electric field can be formed between the wear structure 606 and the solid fuel and oxidant 605. In another embodiment, the perforated flame holder 102 becomes more conductive at an elevated (combustion support) temperature, and the wear structure 606 forms an electric field with one or more portions of the perforated flame holder 102 acting as a second electrode.

According to an embodiment, the counter electrode 607 can be disposed on or adjacent to the output surface 214 of the perforated flame holder 102 and the wear structure 606 can be disposed on or adjacent to the input surface 212 of the perforated flame holder 102. The voltage source 609 can be configured to apply a voltage between the counter electrode 607 or the wear structure 606. According to an embodiment, applying the voltage between the wear structure 606 and the counter electrode 607 includes coupling one of the wear structure 606 and the counter electrode 607 to voltage ground 613.

According to an embodiment, the voltage source 609 is configured to apply a voltage having a first polarity to the counter electrode 607 and to apply a second voltage different from the first voltage to the wear structure 606. It is preferable that the voltages respectively applied to the first and second electrodes 607, 606 differ by at least 1000 volts. In an embodiment, the second voltage is opposite in polarity to the first voltage.

According to an embodiment, the counter electrode 607 is not present. Instead, the voltage source 609 applies a voltage between the wear structure 606 and another conductive structure.

Figure 7:
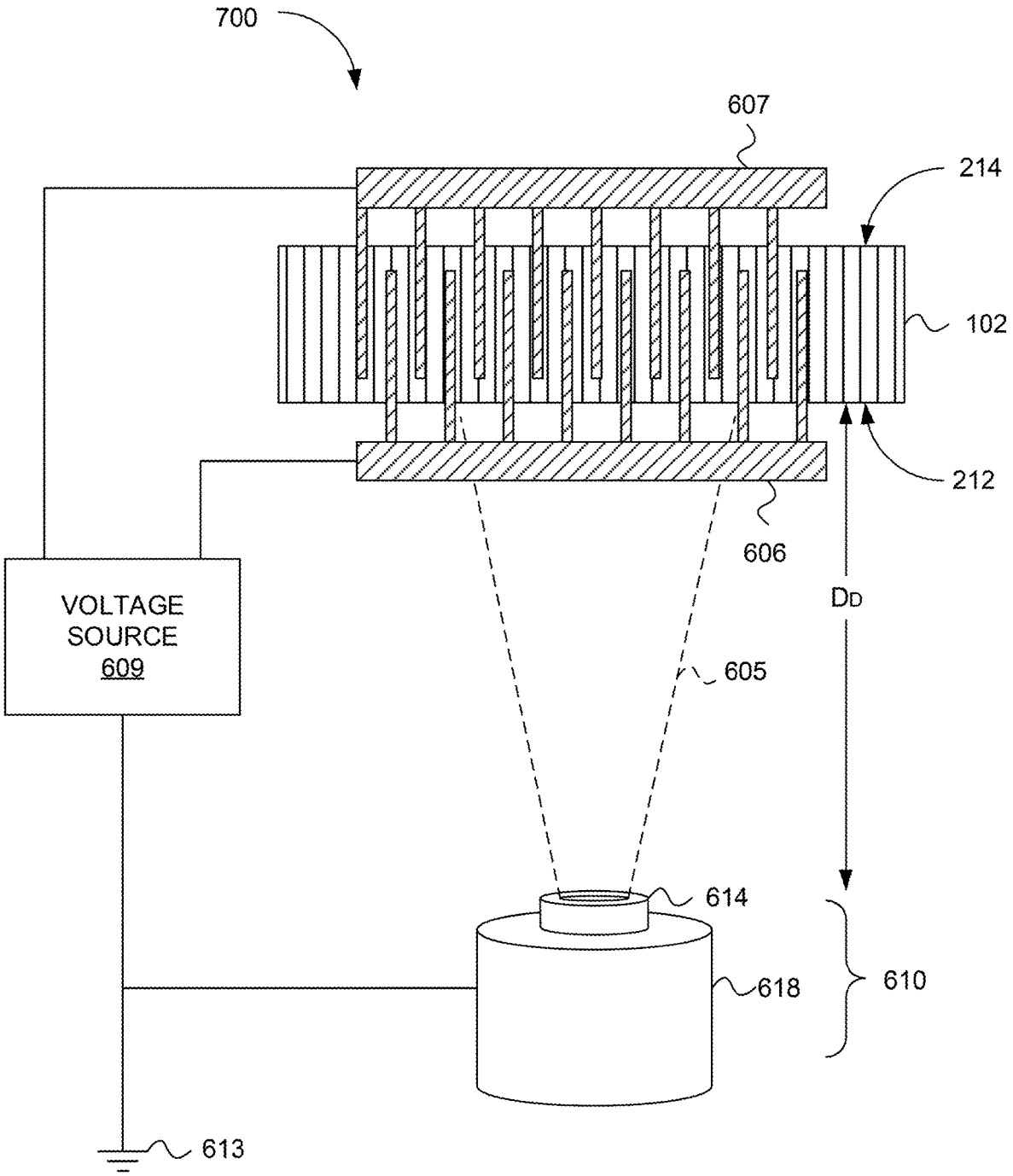
FIG. 7 is a diagram of a combustion system including an electrically conductive wear structure having a plurality of electrode members extending into the perforated flame holder, according to an embodiment.

FIG. 7 is a diagram of a system 700, according to an embodiment. The combustion system 700 includes a perforated flame holder 102, a voltage source 609, a counter wear structure 606, a counter electrode 607, and a solid fuel and oxidant source 610 similar to those disclosed in relation to FIG. 6. According to an embodiment, the wear structure 606 includes a plurality of protruding electrode members extending into the perforated flame holder 102. The counter electrode 607 includes a plurality of counter electrode members extending into the perforated flame holder 102 and not in contact with the plurality of electrode members extending from the wear structure 606.

According to an embodiment, the voltage source 609 is configured to apply a voltage having a first polarity to the wear structure 606 and to apply a voltage having a second polarity to the counter electrode 607.

According to an embodiment, the voltage source 609 is configured to apply a voltage to the counter electrode 607. The wear structure 606 is in continuity with a voltage ground 613. Optionally, the counter electrode 607 can be formed from a conductive portion of the perforated flame holder 102.

Figure 8:
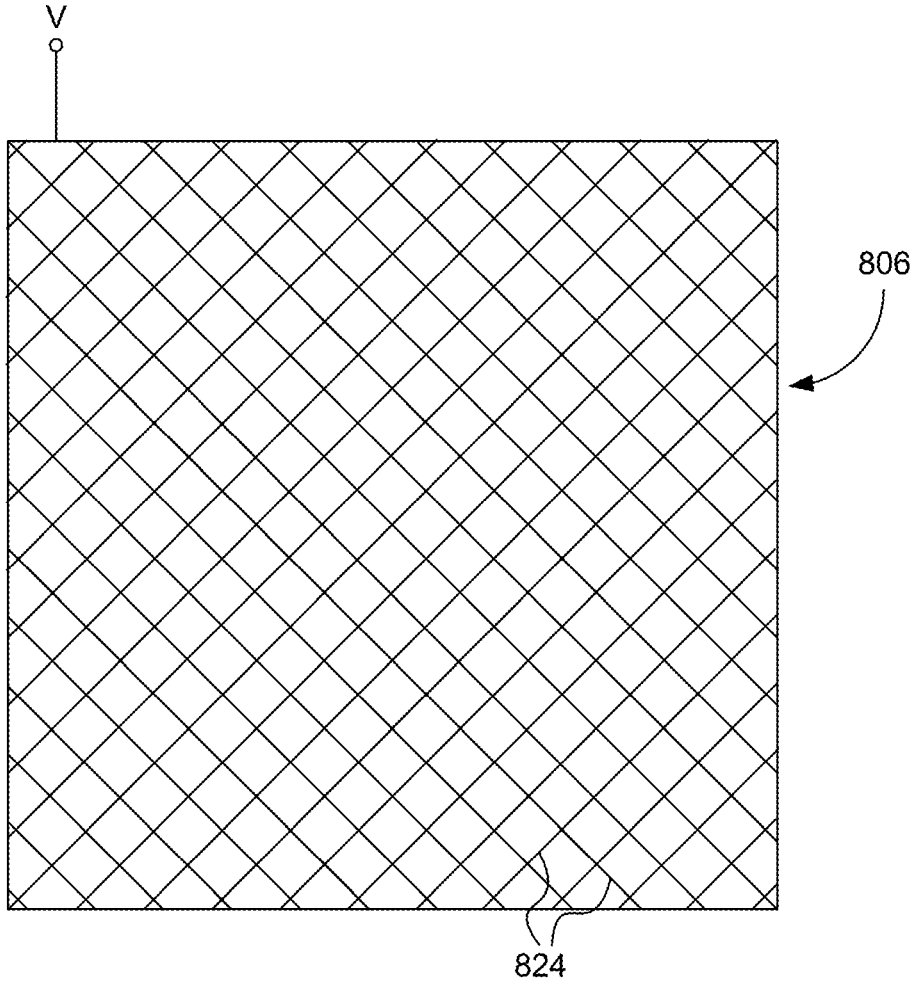
FIG. 8 is a top view of a wear structure configured as conductive screen configured to be positioned on or near a perforated flame holder, according to one embodiment.

FIG. 8 is a bottom view of a wear structure 806, according to an embodiment. The wear structure 806 can be a conductive screen configured to protect an input surface 212 of a perforated flame holder 102 from erosion by a solid fuel 605 and configured to act as an electrode 606 configured to receive a voltage signal from a voltage source 609, according to an embodiment. The wear structure 806 can be placed on or near the input surface 212 of a perforated flame holder 102. According to an embodiment, a second conductive screen can be placed on or near the output surface 214 and can act as a counter electrode 607 coupled to the voltage source 609.

According to an embodiment, the wear structure 606 includes a mesh of wires 824 having gaps between them through which the solid fuel and oxidant 605 can pass. According to an embodiment, the wear structure 606 receives a voltage V from the voltage source 609, thereby electrically influencing the combustion reaction 302 within the perforated flame holder 102.

According to an embodiment, the mesh of wires 824 can form an array that matches the input surface 212 of the perforated flame holder 102 such that the gaps between wires or groups of wires aligns with the perforations 210 of the perforated flame holder 102.

According to an embodiment, the effective area of the wear surface is much greater than the effective area of the input face 212 of the perforated flame holder 102. According to an embodiment, the effective area of the wear surface is an area of the wear surface multiplied by a discharge coefficient of the wear surface. The effective area of the input face 212 is an area of the input face 212 multiplied by a discharge coefficient of the input face 212.

According to an embodiment, the wear structure 806 can include a stainless steel grid shaped to conform to or align with the perforations 210 of the perforated flame holder 102.

Figure 9:
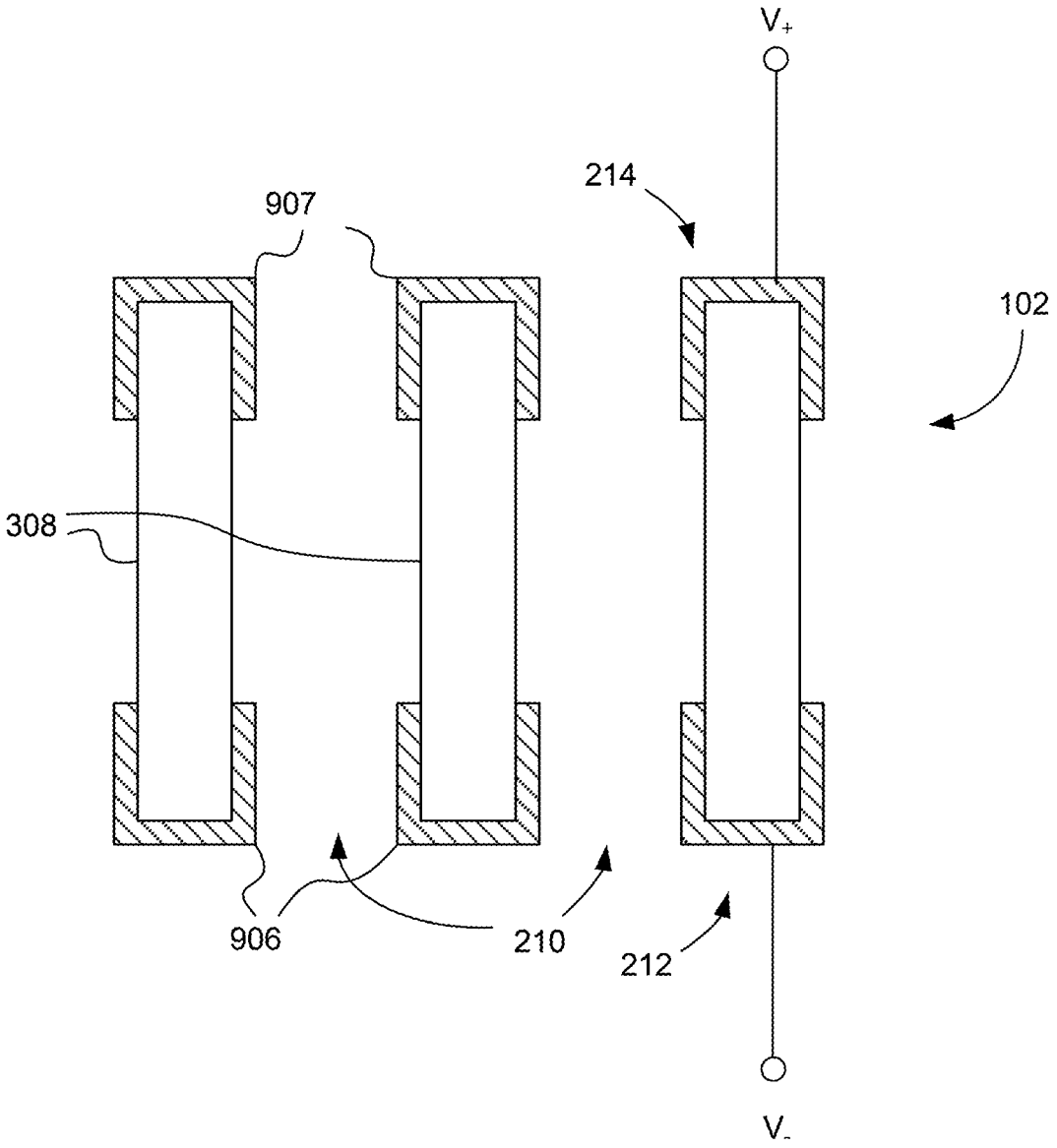
FIG. 9 is an enlarged side view of perforations of a perforated flame holder including an electrically conductive wear structure positioned at the bottom of the perforations, according to one embodiment.

FIG. 9 is an enlarged side view of two perforations 210 of a perforated flame holder 102, according to one embodiment. A wear structure 906 is positioned on walls 308 at the lower portions of the perforations 210 and on the input surface 212 of the perforated flame holder 102. The wear structure 906 is an erosion guard configured to protect the input surface 212 of the perforated flame holder 102 from erosion by the solid fuel 605. The wear structure 906 can also be electrically conductive and configured to act as an electrode coupled to the voltage source 609.

According to an embodiment, a counter electrode 907 is positioned on walls 308 at the upper portions the perforations 210 and on the output surface 214 of the perforated flame holder 102. The counter electrode 907 is configured to receive a voltage signal from the voltage source 609.

According to an embodiment, the wear structure 906 and the counter electrode 907 can be formed of a refractory metal, a conductive paste, a conductive ink or other conductive material applied to the top and bottom of the perforated flame holder 102. The conductive material can be rolled on by a roller that passes over the top and bottom surfaces of the perforated flame holder 102, by pad printing, or in any other suitable manner.

Though shown as physically separate in FIG. 9 due to the nature of the cross-sectional diagram, according to an embodiment, the counter electrode 907 is a single continuous electrode on the output surface 214 and upper portions of the perforations 210. Likewise, the wear structure 906 is a single continuous electrode on the input surface 212 and lower portions of the perforations 210.

According to an embodiment, the wear structure 906 and the counter electrode 907 are coupled to the voltage source 609 (see FIGS. 1-7). The voltage source 609 can apply a high voltage V+ to the counter electrode 907 and a low voltage V− to the wear structure 906, by which the counter electrode 907 and the wear structure 906 can electrically influence the combustion reaction 302 within the perforations 210, for example, by generating a plasma within the perforations 210.

According to an embodiment, the high voltage V+ can be greater than 1000 V while the low voltage V− is ground. Alternatively, the voltage on the counter electrode 907 can be lower than the voltage on the wear structure 906. The voltage source 609 can also apply an alternating voltage between the wear structure 906 and the counter electrode 907.

According to an embodiment, only wear structure 906 may be present.

Figure 10:
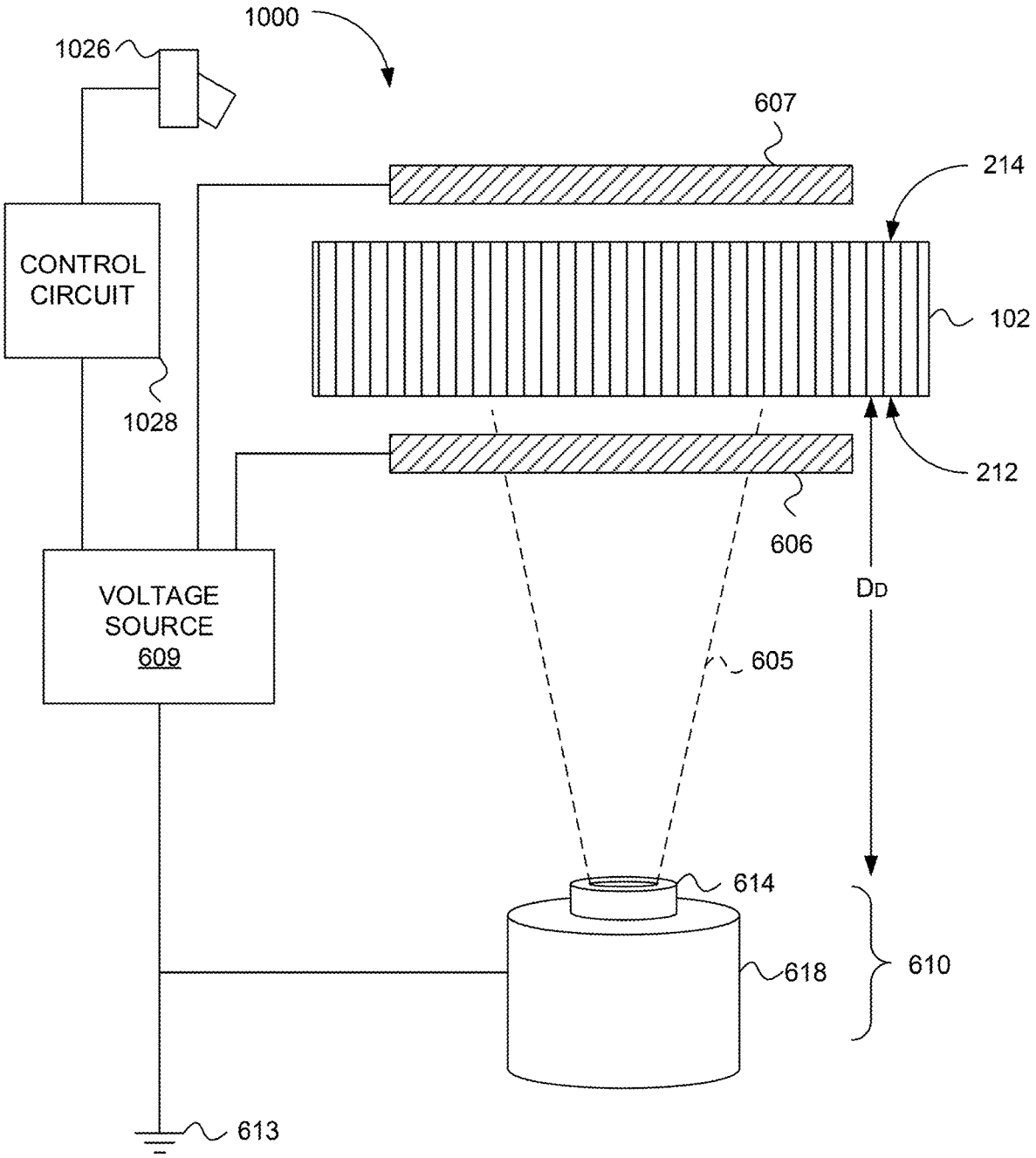
FIG. 10 is a diagram of a combustion system including a control circuit, an image capture device, a voltage source, and an electrically conductive wear structure coupled to the voltage source, according to one embodiment.

FIG. 10 is a diagram of a combustion system 1000, according to an embodiment. The combustion system 1000 includes a solid fuel and oxidant source 610, a perforated flame holder 102, a voltage source 609, a wear structure 606, and a counter electrode 607. The combustion system 1000 further includes an infrared camera 1026 disposed near the perforated flame holder 102 and a control circuit 1028 coupled to the infrared camera 1026 and to the voltage source 609.

According to an embodiment, the infrared camera 1026 captures infrared images of the combustion reaction 302 within the perforations 210 of the perforated flame holder 102. The control circuit 1028 analyzes the images and determines whether the combustion reaction 302 held by the perforated flame holder 102 is similar to a selected image pattern. If the image detected by the infrared camera 1026 does not correspond to the selected image pattern, the control circuit 1028 can modify the voltage between the electrodes 606, 607 to change an electric field in the perforations 620 of the flame holder 102 sufficiently to cause the combustion reaction 302 and perforated flame holder 102 to output infrared radiation corresponding to the selected image pattern.

For example, the control circuit 1028 can determine if the image pattern from the infrared camera 1026 corresponds to a desired ratio of temperature between the perforation walls 308 within the perforated flame holder 102 (referred to as perforation core) and the ends of the perforation walls 308 (i.e., at the output surface 214). It was found that when a perforation core outputs less thermal radiation 304 than the perforation walls 308 at the output surface 214, then the combustion reaction 302 could tend to be occurring in blue flames above the output surface 214, which is disadvantageous with respect to NOx output.

According to an embodiment, when the infrared camera 1026 captures an image with "bright" wall ends, the control circuit 1028 causes the voltage source 609 to increase the voltage difference between the wear structure 606 and the counter electrode 607. This increases reaction rate, and tends to pull the combustion reaction 302 down into the perforation cores. Conversely, when the infrared camera 1026 captures an image with "dark" wall ends, the control circuit 1028 causes the voltage source 609 to decrease the voltage difference between the wear structure 606 and the counter electrode 607. This decreases reaction rate, and tends to distribute the combustion reaction 302 along the length of the perforation cores.

In another embodiment, the control circuit 1028 is operatively coupled to a fuel valve. When the wall ends are bright, the control valve 236 is closed somewhat to reduce convective cooling of the perforated flame holder 102, which causes the combustion reaction 302 to be more fully completed within the perforation cores. This approach can be used to modulate fuel during system start-up, for example, such that fuel flow rate is increased gradually such that a desired thermal image is maintained. The embodiment including the control circuit 1028 operatively coupled to a fuel valve 236 can be useful even without an apparatus configured to apply a voltage to the combustion reaction 302 carried by the perforated flame holder 102.

Although the above description relates to capturing an infrared image of the output surface 214 of the perforated flame holder 102, the techniques described can also be applied to respond to infrared images of the input surface 212 of the perforated flame holder 102.

In one embodiment, the wear structure 606 and the counter electrode 607 can each include multiple individually addressable electrodes. The individually addressable electrodes can each be in or near a respective perforation 210 of the perforated flame holder 102. The voltage source 609, in conjunction with the control circuit 1028, can selectively apply a voltage to individual addressable electrodes to generate an electric field in selected perforations 210 or selected groups of perforations 210.

According to one embodiment, the infrared camera 1026 captures infrared images of the combustion reaction 302 within the perforations 210 of the perforated flame holder 102. The control circuit 1028 analyzes the images and determines which perforations 210 of the perforated flame holder 102 are below a selected threshold temperature or within a selected temperature range. The control circuit can then apply a high-voltage between selected addressable electrodes of the wear structure 606 and the counter electrode 607 in order to apply an electric field to those perforations 210 that are below the threshold temperature. The control circuit 1028 can also remove the high voltage from addressable electrodes in those perforations 210 that are higher than the threshold temperature or are already within the selected temperature range.

While various aspects and embodiments have been disclosed herein, other aspects and embodiments are contemplated, including embodiments in which selected elements of various disclosed embodiments are combined. The various aspects and embodiments disclosed herein are for purposes of illustration and are not intended to be limiting, with the true scope and spirit being indicated by the following claims.

What is claimed is:

1. A combustion system, comprising:

a perforated flame holder, including:

an input face, an output face on a side opposite from, and substantially parallel to, the input face, and a plurality of apertures extending between the input face and the output face;

an electrically conductive erosion guard adjacent to the input face and configured to protect the perforated flame holder from erosion;

an electrically conductive counter electrode adjacent to the output face; and a voltage source configured to generate a plasma within the perforated flame holder by applying a voltage between the erosion guard and the counter electrode.

2. The combustion system of claim 1, wherein the voltage source, the erosion guard, and the counter electrode are configured to generate a plasma within the perforated flame holder when the voltage source applies the voltage between a wear surface and the counter electrode.

3. The combustion system of claim 1, wherein the voltage is at least 10,000 volts.

4. The combustion system of claim 1, wherein the erosion guard is a conductive refractory metal.

5. The combustion system of claim 1, wherein the erosion guard is a metal screen.

6. The combustion system of claim 5, wherein the metal screen is in contact with the perforated flame holder.

7. The combustion system of claim 1, wherein the erosion guard includes a conductive material disposed on a surface of the perforated flame holder.

8. The combustion system of claim 1, wherein the erosion guard includes a conductor disposed at least partially within the perforated flame holder.

9. The combustion system of claim 1, wherein the erosion guard includes a stainless steel grid.

10. A combustion system, comprising:

a perforated flame holder, including:

an input face, an output face on a side opposite from the input face, and a plurality of apertures extending between the input face and the output face; and a wear surface adjacent to the input face and configured to protect the perforated flame holder from erosion.

11. The combustion system of claim 10, wherein the wear surface is integral with the perforated flame holder, and corresponds to the input face.

12. The combustion system of claim 10, wherein the perforated flame holder and the wear surface are formed concurrently.

13. The combustion system of claim 11, wherein the perforated flame holder and the wear surface are formed from respective compositions of material placed together in a mold.

14. The combustion system of claim 10, wherein the perforated flame holder and the wear surface are formed in separate processes.

15. The combustion system of claim 14, wherein the wear surface is formed over the input face of the perforated flame holder.

16. The combustion system of claim 14, wherein the perforated flame holder and the wear surface are formed separately, and subsequently coupled together.

17. The combustion system of claim 10, wherein the wear surface is in physical contact with the input face of the perforated flame holder.

18. The combustion system of claim 10, wherein the wear surface is spaced apart from the input face of the perforated flame holder.

19. The combustion system of claim 10, wherein the wear surface includes a metal.

20. The combustion system of claim 10, further comprising a voltage source communicably coupled to the wear surface.

21. The combustion system of claim 20, further comprising a counter electrode positioned adjacent to the output face and communicably coupled to the voltage source.

22. The combustion system of claim 21, wherein the voltage source is configured to apply a voltage between the wear surface and the counter electrode.

23. The combustion system of claim 22, wherein the voltage source, the wear surface, and the counter electrode are configured to generate a plasma within the perforated flame holder when the voltage source applies the voltage between the wear surface and the counter electrode.

24. The combustion system of claim 22, wherein the voltage is a DC voltage.

25. The combustion system of claim 22, wherein the voltage an AC voltage.

26. The combustion system of claim 22, wherein the voltage is greater than 1000 volts.

27. The combustion system of claim 22, wherein the voltage is at least 10,000 volts.

28. The combustion system of claim 22, wherein the wear surface is a conductive refractory metal.

29. The combustion system of claim 22, wherein the wear surface is a metal screen.

30. The combustion system of claim 29, wherein the metal screen is in contact with the perforated flame holder.

31. The combustion system of claim 22, wherein the wear surface includes a conductive material disposed on the input face of the perforated flame holder.

32. The combustion system of claim 22, wherein the wear surface includes a conductor disposed at least partially within the perforated flame holder.

33. The combustion system of claim 22, wherein the wear surface includes a stainless steel grid.

* * * * *